US009064438B2

(12) United States Patent
Hwang

(10) Patent No.: US 9,064,438 B2
(45) Date of Patent: Jun. 23, 2015

(54) METHOD AND AN APPARATUS OF COMPENSATING FOR DISPLAY DEFECT OF FLAT PANEL DISPLAY

(75) Inventor: Jeongtae Hwang, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 1177 days.

(21) Appl. No.: 12/509,844

(22) Filed: Jul. 27, 2009

(65) Prior Publication Data

US 2010/0141559 A1 Jun. 10, 2010

(30) Foreign Application Priority Data

Dec. 10, 2008 (KR) ..... 10-2008-0125210

(51) Int. Cl.
*G09G 5/00* (2006.01)

(52) U.S. Cl.
CPC ..... *G09G 5/003* (2013.01); *G09G 2320/0233* (2013.01); *G09G 2320/0693* (2013.01); *G09G 2330/12* (2013.01)

(58) Field of Classification Search
CPC ..... G09G 2320/0285; G09G 2330/10; G09G 2320/0233; G09G 3/006; G09G 2320/0693; G09G 2320/043; G09G 2320/046; G09G 2320/0271; G09G 2320/0295; G09G 2320/0673; G09G 5/003; G02F 1/1309
USPC ..... 345/55, 84–89, 204, 690, 98
See application file for complete search history.

(56) References Cited

U.S. PATENT DOCUMENTS

| | | | | |
|---|---|---|---|---|
| 7,719,596 | B2 * | 5/2010 | Katayama et al. | 348/333.12 |
| 7,847,772 | B2 * | 12/2010 | Choi et al. | 345/89 |
| 2002/0067326 | A1 * | 6/2002 | Aoki | 345/89 |
| 2005/0093798 | A1 * | 5/2005 | Kamada et al. | 345/89 |
| 2006/0007196 | A1 * | 1/2006 | Chen | 345/204 |
| 2007/0085790 | A1 * | 4/2007 | Chung et al. | 345/88 |
| 2007/0091041 | A1 * | 4/2007 | Chung et al. | 345/88 |
| 2007/0109245 | A1 * | 5/2007 | Hwang | 345/98 |
| 2009/0135211 | A1 * | 5/2009 | Wang et al. | 345/690 |
| 2010/0013750 | A1 * | 1/2010 | Kerofsky et al. | 345/89 |

* cited by examiner

*Primary Examiner* — Gregory J Tryder
(74) *Attorney, Agent, or Firm* — Morgan, Lewis & Bockius LLP

(57) ABSTRACT

This document relates to electrically compensating for display defects resulting from process error. A method of compensating for a display defect of a flat panel display comprises receiving position information indicative of a position of a display defect of a display panel and level information indicative of a degree of the display defect of the display panel, generating a reference gray level compensation value for compensating for the display defect based on the level information, storing the position information and the reference gray level compensation value in memory, and calculating compensation values for all gray levels by executing gamma point estimation (GPE) functions for expanding the reference gray level compensation value into all the gray levels based on received gain factor control information, modulating digital video data to be displayed in the display defect position by the calculated compensation values, and displaying the modulated digital video data in the display panel.

2 Claims, 5 Drawing Sheets

METHOD AND AN APPARATUS OF COMPENSATING FOR DISPLAY DEFECT OF FLAT PANEL DISPLAY

This application claims the benefit of Korean Patent Application No. 10-2008-0125210 filed on Dec. 10, 2008, which is incorporated herein by reference for all purposes as if fully set forth herein.

BACKGROUND

1. Field

This document relates to a flat panel display, and more particularly, to electrically compensating for display defects resulting from process error.

2. Related Art

Flat panel displays include a liquid crystal display (LCD), a field emission display (FED), a plasma display panel (PDP), an organic light-emitting diode display (OLED), etc. Most of them have been commercialized and came into the market.

Recently, in order to compensate for display defects found in a process of testing a flat panel display, methods of modulating digital video data to be displayed in a display defect area and driving a flat display panel based on the modulated digital video data are being proposed.

Display defects may comprise display spots, bright lines caused by backlight, point defects caused by defective pixels, etc.

The display spot may have a regular shape, such as a point, a line, a belt, a circle, and a polygon, or an irregular shape depending on a cause of occurrence thereof. An area where the display spot is generated has a different color and luminance from those of a normal display surface. The display spot results from a difference in the height of a spacer, parasitic capacitance between signal wirings, parasitic capacitance between a signal wiring and a pixel electrode, an overlap area between the gate and drain of a thin film transistor (hereinafter referred to as a 'TFT') due to a difference between an overlap exposure and the amount of exposure caused by lens aberration, and so on as compared with a normal display surface.

The bright line caused by a backlight is a display defect which may occur in a variety of flat panel displays, in particular, a liquid crystal display. In the liquid crystal display, a backlight is placed in the rear surface of a display panel, and light transmissivity from the rear surface of the display panel to the front surface thereof is controlled. Accordingly, if, in the liquid crystal display, light emitting from the backlight is not uniformly incident on the entire incident surface of the display panel, bright lines appear on the display screen.

The point defect caused by a defective pixel is caused by the opening of a signal wiring, a defective TFT, a defective electrode pattern, etc. The point defect caused by a defective pixel results in a dark point or spot in the display screen. Since a spot is conspicuously seen by the naked eye as compared with a dark point, a defective pixel appearing as a spot is processed into a dark point in a conventional repair process. The dark pointed defective pixel is rarely recognized in a black gray level display screen, but is conspicuously recognized as a dark point in display images having an intermediate gray level and a white gray level.

In order to compensate for a display defect, in a conventional method of compensating for display defects of a flat panel display, as shown in FIG. 1, a display defect area within a display panel is designated at step S10, different test data for respective gray levels is displayed in the display defect area at step S20, and compensation data for each gray level is extracted for a display state of the test data through an electrical test using a camera, examination with the naked eye or both at step S30. After the compensation data for each gray level, together with position data to indicate the position of each pixel within the display defect, is stored in memory, display defects are removed through a compensation process using the compensation data at step S50.

However, the conventional method of compensating for display defects of a flat panel display has the following problems.

First, in the conventional method of compensating for display defects of a flat panel display, compensation data for all gray levels is detected. Accordingly, the process time taken to detect the compensation data is long, and memory having a high capacity is required in order to apply the compensation data to an actual display panel. Consequently, this method is disadvantageous in terms of the time and cost.

Second, in the conventional method of compensating for display defects of a flat panel display, compensation data for all gray levels is detected. Accordingly, if compensation data obtained under different conditions for respective gray levels is reflected on consecutive gray level screens, there is a high probability that distorted compensation may be performed. A display defect has a different degree of distribution for each gray level. Here, if the prevision and accuracy in detection for each gray level using a camera is low, the above problem becomes worse at the boundary face of neighboring gray levels.

Third, compensation data is weak against noise when it is actually applied to a display panel. The conventional compensation method requires an additional processor for eliminating this noise.

SUMMARY

An aspect of this document relates to compensating for display defects of a flat panel display, which can reduce the time that it takes to detect compensation data, reduce the capacity of memory for storing compensation data, and increase the accuracy of compensation.

In an aspect, a method of compensating for a display defect of a flat panel display comprises receiving position information indicative of a position of a display defect of a display panel and level information indicative of a degree of the display defect of the display panel, generating a reference gray level compensation value for compensating for the display defect based on the level information, storing the position information and the reference gray level compensation value in memory, and calculating compensation values for all gray levels by executing gamma point estimation (GPE) functions for expanding the reference gray level compensation value into all the gray levels based on received gain factor control information, modulating digital video data to be displayed in the display defect position by the calculated compensation values, and displaying the modulated digital video data in the display panel.

The GPE functions are used to calculate the compensation values for all the gray levels by nonlinearlly changing the reference compensation data in response to the entire gray level area.

The GPE functions are represented by the following equations.

$$M2\text{data}=(M1\text{data}\times\text{Input Data}\times\alpha)\times\beta$$

$$\text{Output Data}=\text{Input Data}\pm M2\text{data}$$

where 'M1data' denotes the reference gray level compensation value, 'Input Data' denotes the digital video data to be displayed in the display defect position, 'α' denotes a parameter fixed for each model and panel, 'β' denotes a parameter for compensating a significance difference between degrees of display defects for respective gray levels, 'M2data' denotes the compensation values for all the gray levels, and 'Output Data' denotes the digital video data modulated by the compensation values.

The gain factor control information is used to minutely control the parameters 'α' and 'β'.

An apparatus for compensating for a display defect of a flat panel display comprises a display panel, a program executor configured to receive position information indicative of a position of a display defect of a display panel and level information indicative of a degree of the display defect of the display panel and to generate a reference gray level compensation value for compensating for the display defect based on the level information, memory configured to store the position information and the reference gray level compensation value, a compensation unit configured to calculate compensation values for all gray levels by executing gamma point estimation (GPE) functions for expanding the reference gray level compensation value into all the gray levels based on received gain factor control information, and modulating digital video data to be displayed in the display defect position by the calculated compensation values, and a driver configured to display the modulated digital video data in the display panel.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION

Hereinafter, an implementation of this document will be described in detail with reference to FIGS. 2 to 6.

Figure 1:
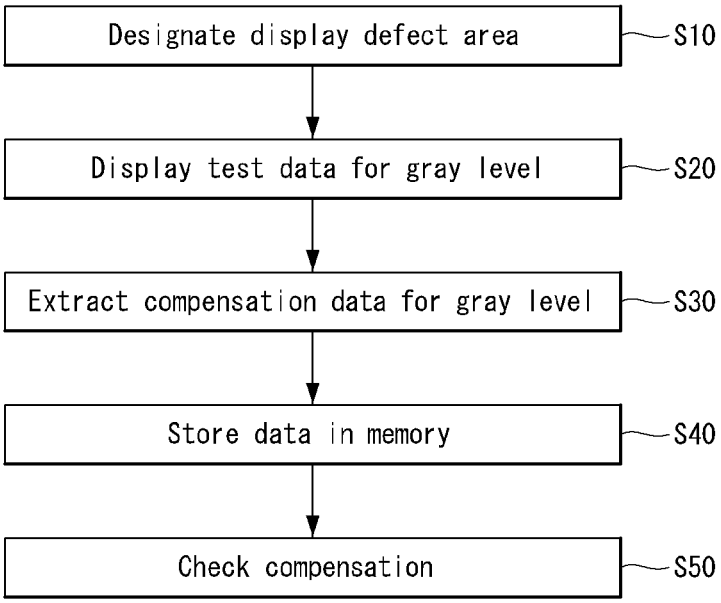
FIG. 1 (Related Art)
FIG. 1 is a flowchart illustrating a conventional method of compensating for display defects of a flat panel display.
Figure 2:
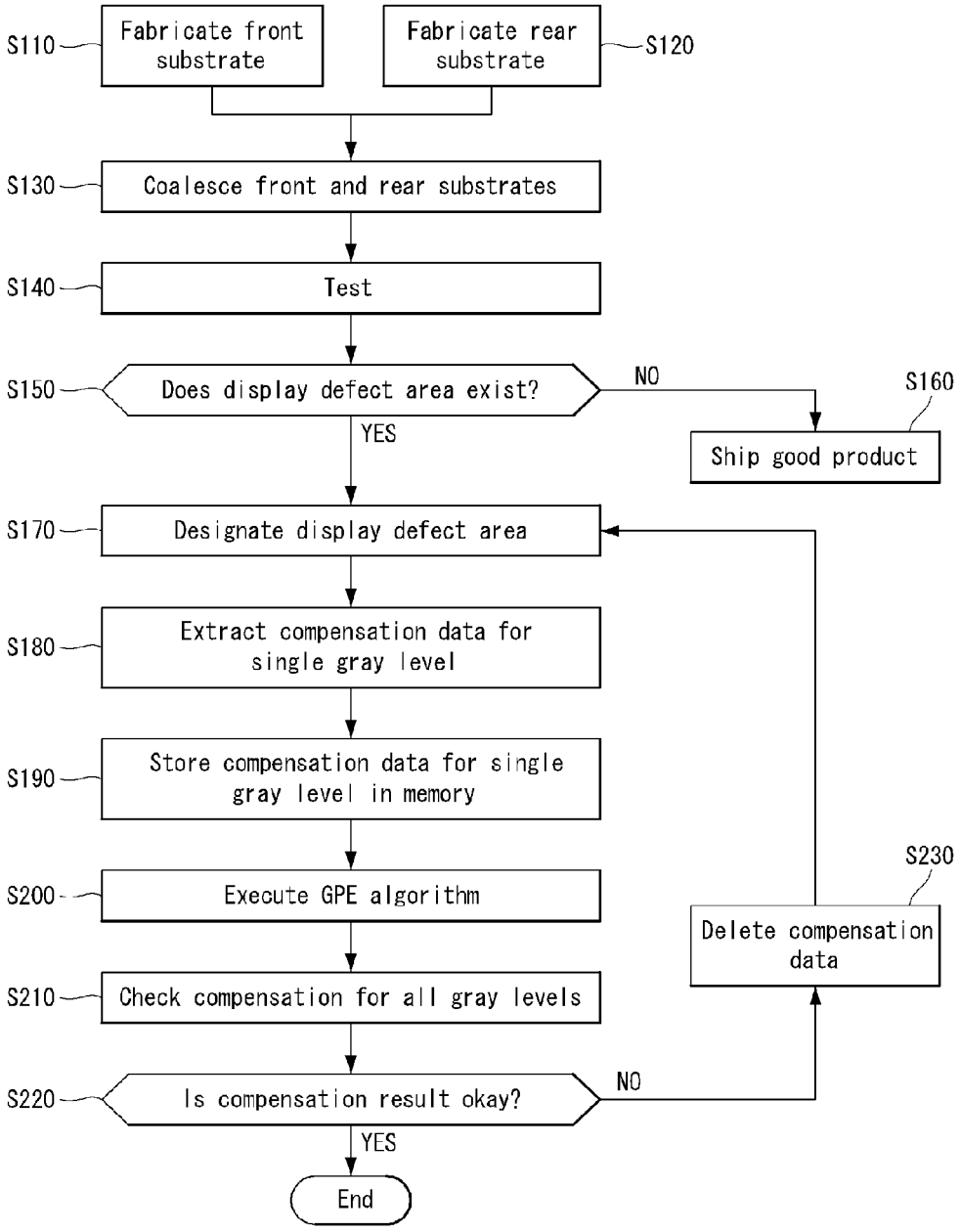
FIG. 2 is a flowchart illustrating a method of compensating for display defects of a flat panel display according to an embodiment of this document.
Figure 3A:
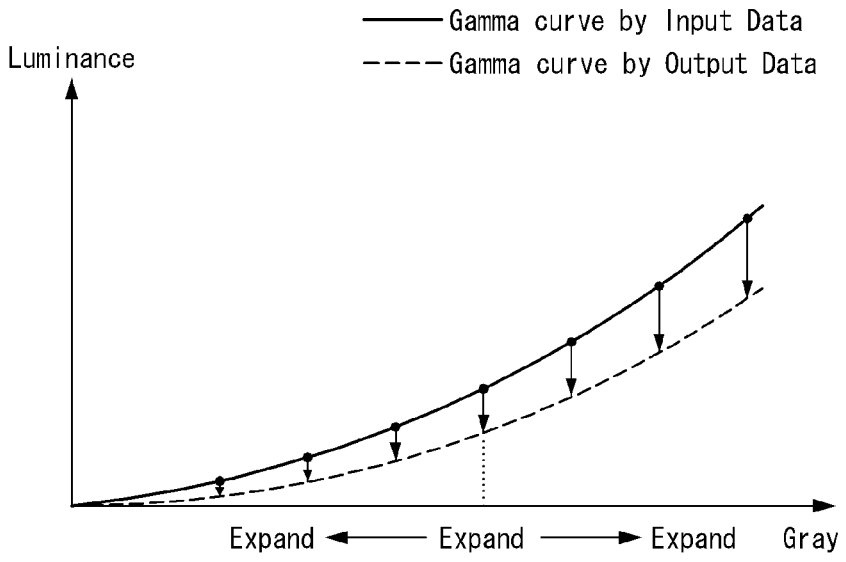
FIGS. 3A and 3B are diagrams showing examples in which compensation data detected in a single gray level has been expanded into the entire gray level area using gamma point estimation (GPE) functions.
Figure 3B:
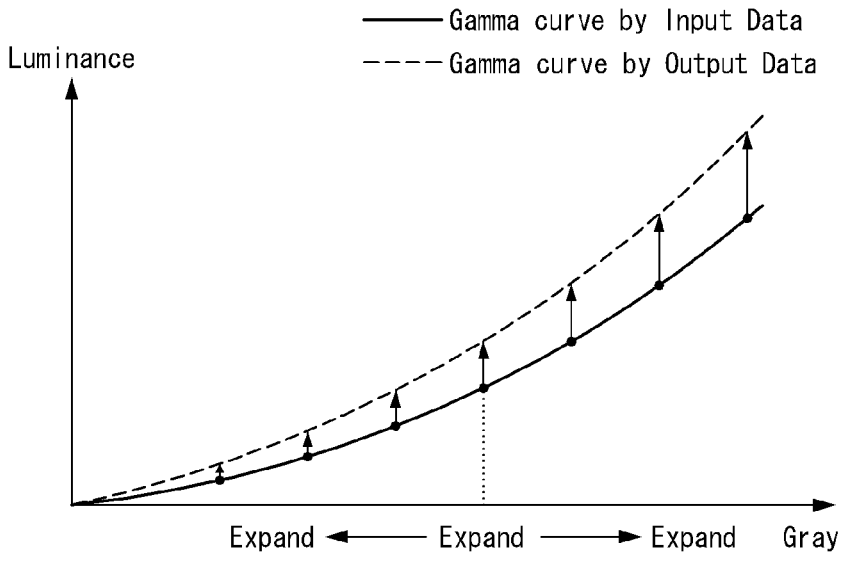
Figure 4:
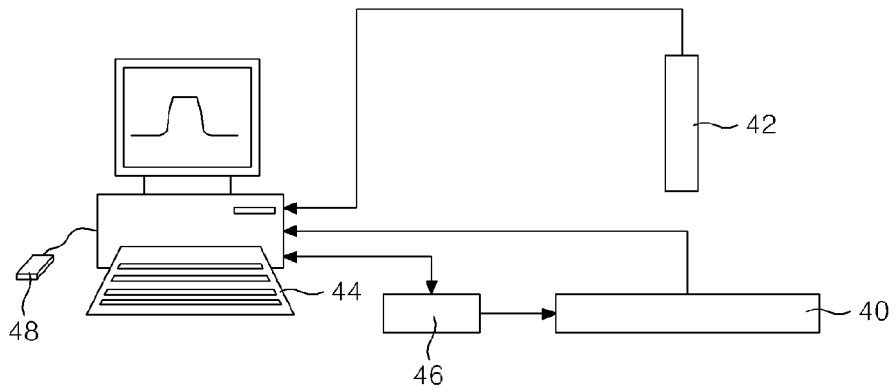
FIG. 4 is a diagram showing a system for analyzing a display defect and determining compensation values, used in the method of FIG. 2.

FIG. 2 is a flowchart illustrating a method of compensating for display defects of a flat panel display according to an embodiment of this document, FIGS. 3A and 3B are diagrams showing examples in which compensation data detected in a single gray level has been expanded into the entire gray level area using gamma point estimation (GPE) functions, and FIG. 4 is a diagram showing a system for analyzing a display defect and determining compensation values, used in the method of FIG. 2.

Referring to FIGS. 2 to 4, in the method of compensating for display defects of a flat panel display according to an embodiment of this document, after a front substrate and a rear substrate are separately fabricated at steps S110 and S120, the front and rear substrates are coalesced together using a sealant or frit glass at step S130. The front and rear substrates may have a variety of shapes depending on a display panel 40. For example, in the case of a liquid crystal display panel, a color filter, black matrices, a common electrode, an upper orientation layer, etc. may be formed in the front substrate, and data lines, gate lines, TFTs, pixel electrodes, a lower orientation layer, column spacers, etc. may be formed in the rear substrate. In the case of a plasma display panel, address electrodes, a lower dielectric material, barrier ribs, phosphors, etc. may be formed in the rear substrate, and an upper dielectric material, an MgO protection layer, and sustain electrode pairs may be formed in the front substrate.

Next, test data having a specific reference gray level is applied to the display panel 40 and displayed thereon. The luminance and the chromaticity of the entire display surface are measured through an electrical test or examination with the naked eye or both for a display state of the test data at step S140. It is then determined whether a display defect exists in the flat panel display at step S150. If, as a result of the determination, the display defect is determined to exist, a display defect area is designated at step S170, and reference gray level compensation data is extracted by performing an electrical test on only the reference gray level using a detection unit 42 as shown in FIG. 4 at step S180. The extracted reference gray level compensation data is stored in memory at step S190. If, as a result of the determination at step S150, the display defect is determined not to exist in the entire display surface, the flat panel display is determined to be good and shipped at step S160.

Next, in the method of compensating for display defects of a flat panel display, compensation data for all gray levels is calculated based on the reference gray level compensation data by executing the GPE functions, such as the following equations 1 and 2, and digital video data to be displayed in display defects is then compensated for using the calculated compensation data at step S200.

$$M2\text{data}=(M1\text{data}\times\text{Input Data}\times\alpha)\times\beta \quad \text{[Equation 1]}$$

$$\text{Output Data}=\text{Input Data}\pm M2\text{data} \quad \text{[Equation 2]}$$

In Equation 1 and 2, 'M1data' denotes compensation data having the reference gray level, 'Input Data' denotes input test data, 'α' denotes a parameter fixed for each model and panel, 'β' denotes a parameter for compensating a significance difference between display defect intensities for respective gray levels, 'M2data' denotes compensation data for all gray levels including a reference gray level, and 'Output Data' denotes output test data for all gray levels to which compensation data has been applied.

The GPE functions are used to nonlinearlly compensate for data according to 'α' and 'β' selected depending on information input by a user (gain factor (GF) selection information according to a panel and a significance difference level). If the GPE functions are used, when a display defect is a spot, input test data can be down-compensated for using compensation data for all gray levels, which has been expanded from compensation data having a reference gray level as shown in FIG. 3A, and, when a display defect is a dark point, input test data can be up-compensated for using compensation data for all gray levels, which has been expanded from compensation data having a reference gray level as shown in FIG. 3B, by properly setting the gain factors 'α' and 'β'. Accordingly, the method of compensating for display defects of a flat panel display can greatly reduce a tact time taken to detect compensation data and a memory capacity necessary to store compensation data because compensation data for only a specific reference gray level is detected and display defects for all gray levels are compensated for based on the compensation data for the specific reference gray level. For example, a conventional tact time taken to detect compensation data for all 256 gray levels is 5120 sec, whereas a tact time taken to detect compensation data according to this document may be 20 sec (i.e., 5120/256). Further, a conventional memory capacity necessary to store compensation data for all 256 gray levels is 20 Mb, whereas a memory capacity necessary to store compensation data according to this document may be 80 Kb (i.e., 20000/256). Moreover, the method of compensating for display defects of a flat panel display can greatly reduce the probability of distorted compensation because display defects are compensated for by nonlinearlly changing one reference compensation data in the entire gray level area, as compared with a conventional method of critically compensating for display defects using different compensation lookup tables for respective gray level periods. In addition, the method of compensating for display defects of a flat panel display may omit an additional processor for eliminating noise because error resulting from noise generated in a compensation process using compensation data can be removed by minutely controlling the gain factors of the GPE functions.

Next, in the method of compensating for display defects of a flat panel display, it is determined whether display defects appear in all gray levels by adding or subtracting compensation data, generated by executing the GPE functions, to or from the test data to be displayed in each pixel of display defects at steps S210 and S220. If, as a result of the determination, the display defects are determined to appear in all gray levels, the compensation data of the reference gray level stored in the memory is deleted at step S230, and the processes (S170 to S220) are performed again. However, if, as a result of the determination at step S220, the display defects are determined not to appear in all gray levels, compensation data at that time is determined as optimized compensation values.

The processes (S150 to S220) may be implemented using a compensation program executed by a program executor 46 as shown in FIG. 4. The compensation program, as described above, automatically determines the position data of a display defect and the reference gray level compensation value of the display defect based on a reference coordinate value and a level of the display defect.

The system for analyzing a display defect and determining compensation values, as shown in FIG. 4, comprises the detection unit 42 for detecting the luminance and chromaticity of the display panel 40, a computer 44 for supplying the display panel 40 with test data and analyzing the luminance and chromaticity of the display panel 40 based on an output signal from the detection unit 42, the program executor 46 for executing a compensation program based on received display defect information, and memory 48 for storing position data and a reference gray level compensation value of a display defect determined by the execution of the compensation program.

The detection unit 42 may comprise a camera or an optical sensor or both. The detection unit 42 is configured to detect the luminance and chromaticity of a test image displayed on the display panel 40, generate voltage or current corresponding to the detected luminance and chromaticity, convert the voltage or current into digital detect data, and supply the computer 44 with the converted data.

The computer 44 is configured to supply the driving circuit of the display panel 40 with test data on a gray level basis and determine the luminance and chromaticity of a test image for a display surface of the display panel 40 in a reference gray level according to digital detect data received from the detection unit 42. When a display defect is detected or a user inputs information about a display defect, the computer 44 operates the program executor 46 based on the determination result of a test image. The computer 44 monitors a change in the luminance and chromaticity of the display defect and determines whether the luminance of the display defect and the luminance of a normal display surface are a preset threshold value or less. If, as a result of the determination, the luminance of the display defect and the luminance of the normal display surface are determined to be the preset threshold value or less, the computer 44 stores compensation values at that time, together with position data, in the memory 46 as optimized compensation values. Here, the threshold value may be experimentally determined so that the difference in the luminance between a display defect area and a normal display area is not seen by the naked eye when the difference is seen in a single reference gray level.

The program executor 46 executes the compensation program based on received information about a display defect so that position data and a reference gray level compensation value of the display defect are automatically determined.

The memory 48 is configured to store the position data and the reference gray level compensation value of the display defect under the control of the computer 44 and is added to the driving circuit of the display panel 40.

Figure 5:
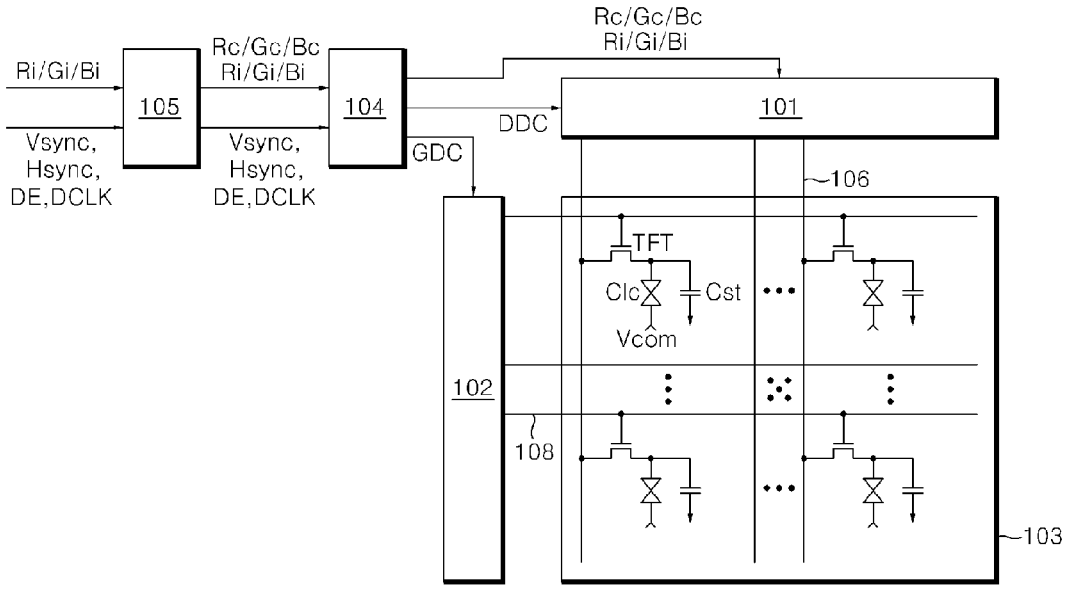
FIG. 5 is a block diagram of a flat panel display according to an embodiment of this document.

FIG. 5 is a block diagram of a flat panel display according to an embodiment of this document. The flat panel display is described by taking a liquid crystal display as an example.

Referring to FIG. 5, the flat panel display according to an embodiment of this document comprises a display panel 103 in which data lines 106 and gate lines 108 cross each other and TFTs for driving respective liquid crystal cells Clc are formed at the intersections of the data lines 106 and the gate lines 108, a compensation circuit 105 for modulating digital video data Ri/Gi/Bi to be displayed in a display defect using a previously stored reference gray level compensation value and GPE algorithms, a data driving circuit 101 for supplying the data lines 106 with modulated data Rc/Gc/Bc, a gate driving circuit 102 for supplying the gate lines 106 with scan signals, and a timing controller 104 for controlling the driving circuits 101 and 102.

The liquid crystal display panel 103 comprises liquid crystal molecules intervened between two sheets of substrates (a TFT substrate and a color filter substrate). The data lines 106 and the gate lines 108 formed on the TFT substrate are orthogonal to each other. Each of the TFTs formed at the intersections of the data lines 106 and the gate lines 108 supplies the pixel electrode of the liquid crystal cell Clc with a data voltage, received via the data line 106, in response to the scan signal from the gate line 108. Black matrices, a color filter, etc. (not shown) are formed in the color filter substrate. A common electrode to which a common voltage Vcom is supplied may be formed on the TFT substrate in the case of an in-plain switching (IPS) mode or a fringe field switching (FFS) mode and may be formed on the color filter substrate in the case of a twisted nematic (TN) mode, an optically compensated bent (OCB) mode, and a vertically alignment (VA) mode. Polarization plates having optical absorption axes which are vertical to each other are respectively attached to the TFT substrates and the color filter substrate.

The compensation circuit 105 is configured to receive (non-modulated) digital video data Ri/Gi/Bi from a system interface and output modulated digital video data Rc/Gc/Bc and the non-modulated digital video data Ri/Gi/Bi to be displayed in a normal display surface. The modulated digital video data Rc/Gc/Bc is controlled upwardly or downwardly by adding or subtracting a previously stored reference gray level compensation value and compensation values, generated using GPE algorithms, to or from the digital video data Ri/Gi/Bi to be displayed in respective pixels of a display defect surface.

The timing controller 104 is configured to supply the data driving circuit 101 with the digital video data Rc/Gc/Bc and Ri/Gi/Bi, received from the compensation circuit 105, in synchronization with a dot clock DCLK and also generate a gate control signal GDC for controlling the gate driving circuit 102 and a data control signal DDC for controlling the data driving circuit 101 using vertical and horizontal sync signals Vsync and Hsync, a data enable signal DE, and the dot clock DCLK. The compensation circuit 105 and the timing controller 104 may be integrated into one chip.

The data driving circuit 101 is configured to convert the digital video data Rc/Gc/Bc and Ri/Gi/Bi, received from the timing controller 104, into analog gamma compensation voltages and supply the data lines 106 with the analog gamma compensation voltages as data voltages.

The gate driving circuit 102 is configured to sequentially supply the gate lines 108 with the scan signals for selecting horizontal lines to which the data voltages will be supplied.

Figure 6:
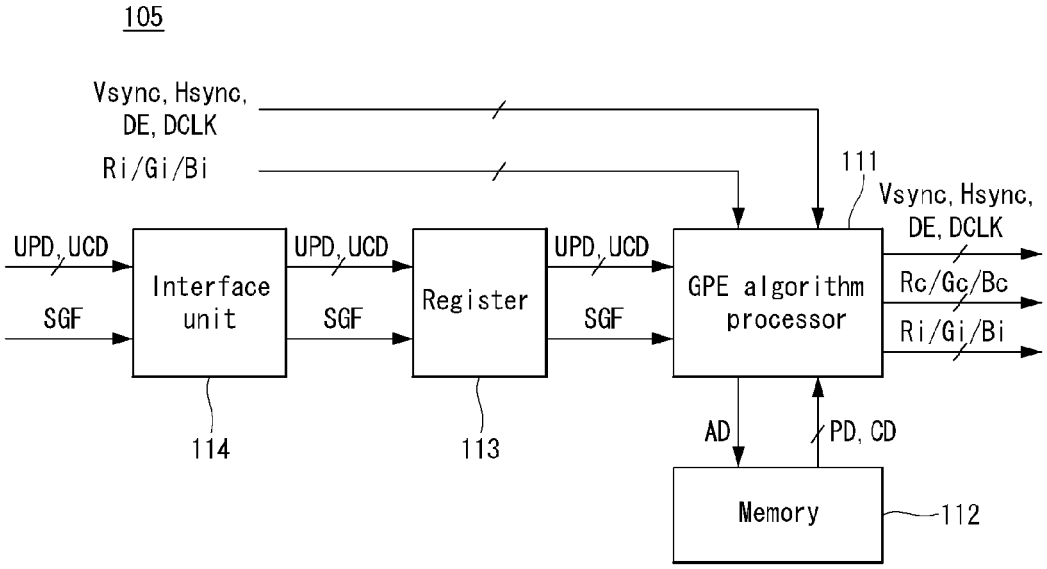
FIG. 6 is a detailed block diagram of a compensation circuit of FIG. 5.

FIG. 6 is a detailed block diagram of the compensation circuit 105 of FIG. 5.

Referring to FIG. 6, the compensation circuit 105 according to an embodiment of this document comprises a GPE algorithm processor 111, memory 112, a register 113, and an interface unit 114.

The GPE algorithm processor 111 is configured to determine display positions of the digital video data Ri/Bi/Gi using the vertical and horizontal sync signals Vsync and Hsync, the data enable signal DE, and the dot clock DCLK, compare the determination results of the display positions and position data PD received from the memory 112, and detect the digital video data Ri/Bi/Gi to be displayed in the display defect area. The GPE algorithm processor 111 is configured to read a reference gray level compensation value CD from the memory 112 using the position data PD of the digital video data Ri/Bi/Gi to be displayed in a display defect as a read address AD. Further, the GPE algorithm processor 111 is configured to calculate compensation values for all gray levels based on the compensation value CD of the reference gray level by executing the GPE functions, as expressed in Equations 1 and 2, with reference to gain factor control information SGF received from the register 113 and to generate the modulated digital video data Rc/Gc/Bc by adding or subtracting the calculated compensation values to the digital video data Ri/Bi/Gi to be displayed in the display defect. Meanwhile, the GPE algorithm processor 111 outputs the digital video data Ri/Bi/Gi to be displayed in a normal display surface without modulation.

The memory 112 is configured to store the position data PD, indicating each of the pixels of the display defect, and the reference gray level compensation value CD in the form of a lookup table. The position data PD and the reference gray level compensation value CD stored in the memory 112 may be updated in response to an electrical signal received via the interface unit 114 from an external computer 44.

The interface unit 114 is configured to perform communication between the compensation circuit 105 and an external system and is designed according to a communication standard protocol, such as I2C. The position data PD and the reference gray level compensation value CD stored in the memory 112 require update because of reasons, such as a process change and a difference between models. A user may input update position data UPD and an update reference gray level compensation value UCD through the external system. If the above reasons are generated, the computer 44 may read or modify data, stored in the memory 112, through the interface unit 114. Further, the gain factors GF of the GPE functions executed in the GPE algorithm processor 111 require some degree of minute control depending on the panel and a significance difference level between gray levels. A user may input the gain factor control information SGF for minutely controlling the gain factors GF to the GPE algorithm processor 111 through the interface unit 114.

The data UPD and UCD, received through the interface unit 114, is temporarily stored in the register 113 in order to update the position data PD and the reference gray level compensation value CD stored in the memory 112.

The liquid crystal display constructed as above may be applied to any flat panel display without a significant change. For example, the liquid crystal display may be substituted by a field emission display (FED), a plasma display panel (PDP), or an organic light-emitting diode display (OLED).

As described above, according to the method and apparatus for compensating for display defects of a flat panel display according to this document, compensation data for a specific reference gray level is detected, and display defects for all gray levels can be compensated for through the execution of the GPE functions based on the detected compensation data. Accordingly, the tact time taken to detect compensation data and a memory capacity necessary to store compensation data can be reduce greatly.

Further, according to the method and apparatus for compensating for display defects of a flat panel display according to this document, display defects are compensated for by nonlinearlly changing one reference compensation data in the entire gray level area. Accordingly, a probability that distorted compensation is performed can be reduced significantly as compared with a conventional method of critically compensating for display defects using different compensation lookup tables for respective gray level periods.

Further, according to the method and apparatus for compensating for display defects of a flat panel display according to this document, error resulting from noise generated in a compensation process using compensation data can be removed by minutely controlling the gain factors GF of the GPE functions. Accordingly, an additional processor for eliminating noise may be omitted.

While this document has been described in connection with what is presently considered to be practical exemplary embodiments, it is to be understood that this document is not limited to the disclosed embodiments, but, on the contrary, is intended to cover various modifications and equivalent arrangements included within the spirit and scope of the appended claims.

What is claimed is:

1. A method of compensating for a display defect of a flat panel display, comprising:

detecting a display defect of a display panel in a specific reference gray level and receiving position information indicative of a position of the display defect and level information indicative of a degree of the display defect;

generating a reference gray level compensation value for compensating for the display defect in the specific reference gray level based on the level information;

storing the position information and the reference gray level compensation value in memory; and calculating compensation values for all gray levels by executing gamma point estimation (GPE) functions for expanding the reference gray level compensation value into all the gray levels based on received gain factor control information, modulating digital video data to be displayed in the display defect position by the calculated compensation values, and displaying the modulated digital video data in the display panel, wherein the gamma point estimation functions use only one reference gray level compensation value to obtain compensation values for all gray levels, wherein the gain factor control information includes a parameter fixed for each model and panel, and a parameter for compensating a significance difference between degrees of display defects for respective gray levels, wherein the gain factor control information is used to minutely control the parameters, wherein the GPE functions are used to calculate the compensation values for all the gray levels by nonlinearly changing the reference compensation data in response to the entire gray level area, and wherein the GPE functions are represented by the following equations, $$M2\text{data}=(M1\text{data}\times\text{Input Data}\times\alpha)\times\beta$$

$$\text{Output Data}=\text{Input Data}\pm M2\text{data}$$

where 'M1data' denotes the only one reference gray level compensation value, 'Input Data' denotes the digital video data to be displayed in the display defect position, 'α' denotes the parameter fixed for each model and panel, 'β' denotes the parameter for compensating the significance difference between degrees of display defects for respective gray levels, 'M2data' denotes the compensation values for all the gray levels, and 'Output Data' denotes the digital video data modulated by the compensation values.

2. An apparatus for compensating for a display defect of a flat panel display, comprising:

a display panel;

a program executor configured to detect a display defect of a display panel in a specific reference gray level and to receive position information indicative of a position of the display defect and level information indicative of a degree of the display defect and to generate a reference gray level compensation value for compensating for the display defect in the specific reference gray level based on the level information;

memory configured to store the position information and the reference gray level compensation value;

a compensation unit configured to calculate compensation values for all gray levels by executing gamma point estimation (GPE) functions for expanding the reference gray level compensation value into all the gray levels based on received gain factor control information, and modulating digital video data to be displayed in the display defect position by the calculated compensation values; and a driver configured to display the modulated digital video data in the display panel, wherein the gamma point estimation functions use only one reference gray level compensation value to obtain compensation values for all gray levels, wherein the gain factor control information includes a parameter fixed for each model and panel, and a parameter for compensating a significance difference between degrees of display defects for respective gray levels, wherein the gain factor control information is used to minutely control the parameters, wherein the GPE functions are used to calculate the compensation values for all the gray levels by nonlinearly changing the reference compensation data in response to the entire gray level area, and wherein the GPE functions are represented by the following equations, $$M2\text{data}=(M1\text{data}\times\text{Input Data}\times\alpha)\times\beta$$

$$\text{Output Data}=\text{Input Data}\pm M2\text{data}$$

where 'M1data' denotes the only one reference gray level compensation value, 'Input Data' denotes the digital video data to be displayed in the display defect position, 'α' denotes the parameter fixed for each model and panel, 'β' denotes the parameter for compensating the significance difference between degrees of display defects for respective gray levels, 'M2data' denotes the compensation values for all the gray levels, and 'Output Data' denotes the digital video data modulated by the compensation values.

* * * * *